US006149003A

United States Patent [19]

Day

[11] Patent Number: 6,149,003

[45] Date of Patent: Nov. 21, 2000

[54] PROTECTION SYSTEM FOR COLLECTIBLE CARDS

[75] Inventor: David Day, San Diego, Calif.

[73] Assignee: Bruce Brown and Frank Barone, National City, Calif.

[21] Appl. No.: 09/392,538

[22] Filed: Sep. 9, 1999

[51] Int. Cl.[7] ..... B65D 85/48

[52] U.S. Cl. ..... 206/449; 206/776; 206/232; 206/38; 383/86; 150/150

[58] Field of Search ..... 206/449, 776, 206/777, 778, 579, 232, 37, 0.84, 38; 150/145, 147, 150; 383/84, 86; 190/902; 40/791

[56] References Cited

U.S. PATENT DOCUMENTS

| | | | |
|---|---|---|---|
| H1363 | 10/1994 | Leeker | 383/84 |
| D. 326,016 | 5/1992 | Guaresi | D3/36 |
| D. 326,360 | 5/1992 | Tasou | D3/44 |
| D. 367,355 | 2/1996 | Fleming, Jr. | D3/218 |
| 4,153,091 | 5/1979 | Jahn | 206/37 |
| 4,979,619 | 12/1990 | Hager | 206/509 |
| 5,040,671 | 8/1991 | Hager | 206/39 |
| 5,159,964 | 11/1992 | Baker et al. | 150/147 |
| 5,168,988 | 12/1992 | Johnston | 206/0.81 |
| 5,186,566 | 2/1993 | Cameron | 206/449 |
| 5,850,754 | 12/1998 | Dobbins | 206/38 |
| 5,873,456 | 2/1999 | Hull et al. | 206/38.1 |

*Primary Examiner*—Paul T. Sewell
*Assistant Examiner*—Nyan T. Lam
*Attorney, Agent, or Firm*—Frank D. Gilliam

[57] ABSTRACT

A system for protecting collectible cards and the like. A transparent card holder holds the collectible card and an authentication certificate. The card holder is sealed to prevent removal of the card and certificate. A light impervious pouch receives the card holder to protect against fading of the card due to ultraviolet light exposure and to prevent scratching or other damage to the card holder. The pouch includes a transparent window through which the authentication certificate can be viewed without removing the card holder from the pouch. A flap covers the opening in the pouch through which the card holder is inserted. The pouch is formed from a soft material that will not scratch the card holder.

7 Claims, 1 Drawing Sheet

PROTECTION SYSTEM FOR COLLECTIBLE CARDS

FIELD OF THE INVENTION

This invention relates to holders for collectible cards that typically bear pictures of sports figures and the like. In particular the holder will protect valuable cards, such as those autographed by the sports figure from environmental damage.

BACKGROUND OF THE INVENTION

Cards bearing pictures of baseball players have been given as a premium with packs of gum for a great many years. Youngsters, primarily boys interested in baseball, would assemble collections of these cards. More recently, cards carrying other pictures, such as football and other sports figures, military aircraft, etc. have been offered as premiums with a variety of products. Collecting such cards has become very popular, with early or rare cards becoming quite valuable.

Originally, cards were simply kept in the proverbial cigar boxes or displayed in frames. With time, handling and exposure to ultraviolet light in sunlight and incandescent light, cards tended to wear and fade. As more people began to collect such cards, rare or early cards have become quite valuable. Collectors began to store the cards in paper sleeves, envelopes or plastic bags to protect them from environmental damage. Ideally, the cards would be stored in a manner allowing viewing of the cards while protecting them against fading and physical damage. Plastic sleeves or other holders protect against wear quite well, but generally do not protect against fading. Thus, present storage methods do not provide maximum protection while allowing the card image to be viewed.

Old or rare cards, cards bearing an original autograph of the subject and cards showing rookie players who later become stars can be extremely valuable.

Collectors sometimes obtain autographs of persons pictured on cards or those having a relationship to the cards subject matter. These cards are much more valuable than unsigned cards. This has developed to the point where significant amounts of money are being charged for the autographs and some companies pay to have series of cards autographed for later sale at high prices. This has, of course, resulted in forged signatures and fraudulent reproduction of old, valuable cards. Legitimate providers of autographed or valuable cards now often provide certificates of authenticity which should always be kept with the corresponding card. Despite such care, forgeries do occur and certificates do become separated from corresponding cards, greatly reducing the card's value.

Thus there is a continuing need for inexpensive card protection systems for collectible cards and the corresponds certificates of authenticity, that will protect the cards from wear, damage and fading while allowing the cards and certificates to be viewed when desired.

SUMMERY OF THE INVENTION

The above-noted problems, and others, are overcome by this invention, which basically comprises a card protection system comprising a transparent card holder and a light impervious pouch for containing in the holder. The card holder comprises front and back transparent sheet walls, upstanding ribs formed on at least one inner wall surface surrounding spaces corresponding to the dimensions of a card and a certificate of authenticity to be held in selected positions therein. The front and back walls can be bonded together by ultrasonic welding, adhesive bonding or the like after the card and certificate have been placed therein. The holder then cannot be opened and cards changed or substituted without damage to the holder making the opening readily apparent.

In order to protect the card and certificate from light exposure and resulting fading, a pouch having a soft inner surface of felt or the like is provided to receive the holder via an end opening. The pouch is sized to receive the holder and preferably has a closeable flap at one end to prevent inadvertent slipping of the holder out of the pouch. The flap can be releasably closed by any suitable means such a snap fastener of hook-and-loop material of the sort marketed under the Velcro® trademark or may simply tuck under an elastic strap across the pouch end adjacent to the flap. The pouch may be formed from any flexible, light impervious material, such as cloth, leather, flexible plastic and the like.

While it is preferred that the card always be covered while in the pouch, a window of transparent plastic sheet or the like may be provided in a pouch wall adjacent to the certificate of authenticity, so that the card can be identified without removing the holder from the pouch. The certificate can be printed with highly light resistant ink. Generally the multi-colored card is printed with inks having low light fading resistance, in particular this true with the older, more valuable cards.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
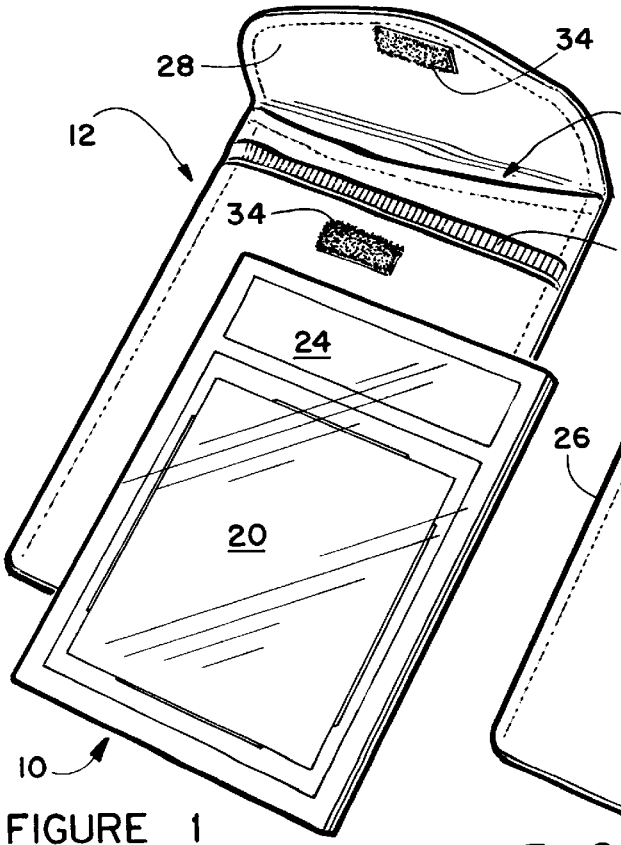
FIG. 1 is a perspective view of the card holder and pouch of this invention.
Figure 2:
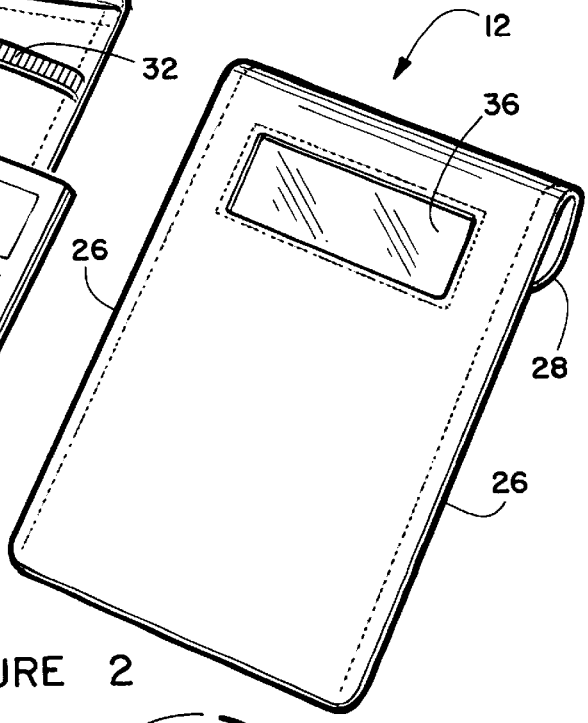
FIG. 2 is a perspective view of the opposites side of the pouch.
Figure 3:
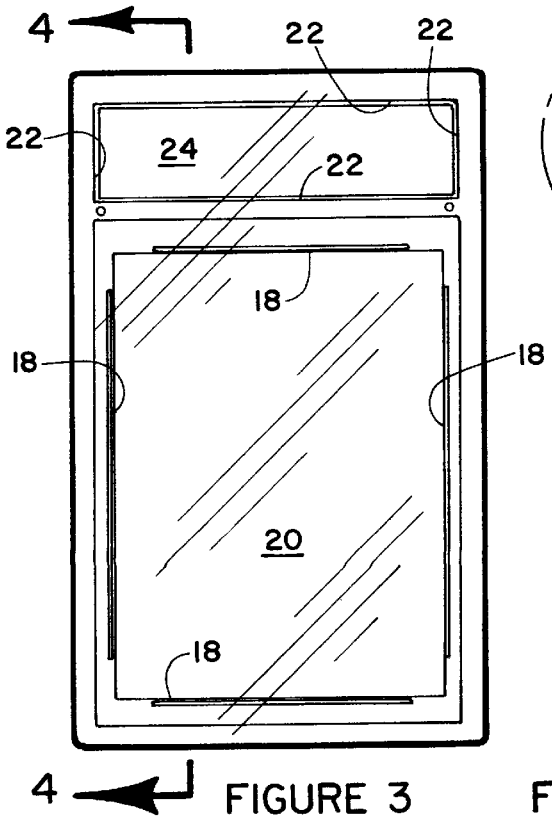
FIG. 3 is an elevation view of the front side of the card holder.

Referring now to FIG. 1 there is seen a card holder 10 and a pouch 12 for receiving the card holder.

Figure 4:
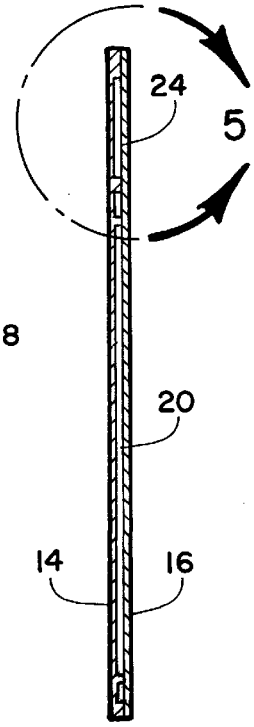
FIG. 4 is a section view of the cardholder, taken on line 4—4 in FIG. 3.
Figure 5:
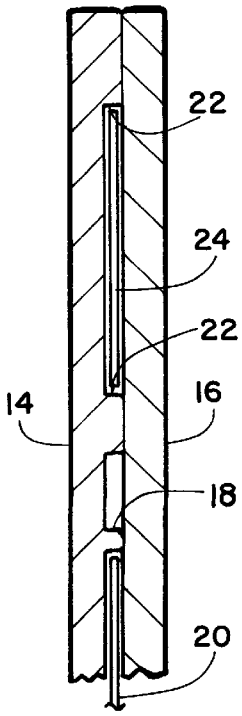
FIG. 5 is an enlarged detail view of a portion of the section view of FIG. 4.

Card holder 10, as seen in FIGS. 1 and 3–5, is formed from a transparent material, such as an acrylic or polystyrene material. As best seen in FIG. 4 and 5, card holder 10 includes first and second formed sheets or walls 14 and 16. At least one of walls 14 and 16 includes a first set of four raised ribs 18 extending toward the other wall which define a space 20 sized to receive a collectible card (not shown). Ribs 18 form a space that is in loose contact with the card to prevent undesirable pressure on the card. A second set of four similar ribs 22 cooperate with one rib 18 to define a space 24 sized to receive an authentication card, carrying information about the collectible card and certifying that the card is authentic.

In use, a collectible card is placed in space 20, and authentication card is placed in space 24, the two sheets 14 and 16 are brought together and sealed. Ultrasonic sealing is preferred, although adhesive bonding or any other suitable method can be used. In order to remove either card, the card holder must be cut apart, clearly revealing tampering with the holder.

This card holder 10 will assure that the contents are as indicated on the collectible card and authentication card. Further, the holder will protect the collectible card against wear or damage through handling. Both sides of the collectible card will be clearly visible through sheets 14 and 16.

Pouch 12 is provided to protect the collectible card against fading due to exposure to light; in particular ultraviolet light. Pouch 12 may be formed from any suitable flexible material. Preferably, the pouch will be formed from a cloth with a soft felt interior that will not scratch card holder 10 during insertion and removal. As best seen in FIG. 1, pouch 12 may be formed from a single elongated strip of material, sewn along edges 26 and having a hemmed flap 28.

When a card holder 10 is inserted through opening 30 into pouch 12, flap 28 is folded down over the opening. Flap 28 can be releasably held in the closed position by any suitable means, such as a elastic strap 32 under which the flap can be tucked and/or pieces of hook-and-loop material 34 that engage when the flap is closed. Thus, the collectible card can be stored and carried while fully protected against light and scratching of holder 10.

In order to allow an authentication card in space 24 to be examined without opening pouch 12 and removing card holder 10, a transparent window 36 is mounted over an opening in the back of pouch 12 adjacent to space 24. Window 36 is preferably formed from a flexible material such as styrene and can be fastened to pouch in any suitable manner such as sewing, adhesive bonding, ultrasonic welding if pouch 12 is formed from an appropriate material, etc.

This overall combination of card holder 10 and pouch 12 will thus prevent tampering with a housed collectible card and authentication card, prevent sear on the card and prevent fading due to exposure to ultraviolet light.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A protection system for collectible cards which comprises:

a card holder comprising first and second sheets of transparent material;

said first and second sheets including means for receiving a collectible card and said authentication card between said sheets in predetermined first and second spaces;

said sheets being bondable together to secure said collectible card and said authentication card between said sheets;

a pouch formed from light impervious material and having an opening for receiving said card holder;

means for closing said opening; and a window made of transparent material in said pouch, said window configured to lie adjacent to said second space when a card holder is in place in said pouch so that said authentication card in said card holder can be viewed without removing said card holder from said pouch.

2. The protection system according to claim 1 further including:

upstanding ribs on said first sheet of transparent material, said ribs extending toward said second sheet of transparent material when said sheets are abutting;

said ribs configured to surround said first space sized to receive a collectible card and to surround said second space sized to receive said authentication card;

said sheets being bondable together by bonding said ribs against said second sheet of transparent material to secure said collectible card and said authentication card in said predetermined spaces.

3. The protection system according to claim 1 further including a flap on said pouch adjacent to said opening for moving between a first position allowing insertion and removal of said card holder and a second position preventing insertion and removal of said card holder.

4. The protection system according to claim 3 further including an elastic band located to permit said flap to cover said opening and tuck under said elastic band to releasably hold said flap in said second position.

5. The protection system according to claim 3 further including hook-and-loop fastening material on said flap and said pouch to releasably hold said flap in said second position.

6. The protection system according to claim 1 wherein said pouch is formed from a flexible material having a soft, felt-like interior surface to avoid scratching said card holder.

7. The protection system according to claim 1 wherein said window is formed from a flexible transparent plastic material.

* * * * *